United States Patent [19]

Hanselman et al.

[11] 4,359,518

[45] Nov. 16, 1982

[54] STRIPPING SHEET FOR USE WITH DIFFUSION TRANSFER FILM UNIT

[75] Inventors: Raymond B. Hanselman, Concord; Karl J. Schreiber, Waban, both of Mass.

[73] Assignee: Polaroid Corporation, Cambridge, Mass.

[21] Appl. No.: 277,944

[22] Filed: Jun. 26, 1981

[51] Int. Cl.[3] ..... G03C 5/54; G03C 7/00

[52] U.S. Cl. ..... 430/236; 430/215; 430/244; 430/245; 430/248; 430/256

[58] Field of Search ..... 430/227, 228, 244, 245, 430/248, 236, 237, 215, 256

[56] References Cited

U.S. PATENT DOCUMENTS

| | | | |
|---|---|---|---|
| 3,416,921 | 12/1968 | Coenen | 430/256 |
| 3,674,482 | 7/1972 | Hablehin | 430/228 |
| 3,677,753 | 7/1972 | Francis et al. | 430/245 |
| 3,930,864 | 1/1976 | Abel et al. | 430/213 |
| 4,056,392 | 11/1977 | Scott | 430/228 |

*Primary Examiner*—Richard L. Schilling
*Attorney, Agent, or Firm*—Philip G. Kiely

[57] ABSTRACT

A stripping sheet adapted for use with a diffusion transfer film unit to remove at least the photosensitive layer from said film unit subsequent to processing is disclosed, as well as methods for using said stripping sheet, wherein said stripping sheet comprises a support, carrying in order, a water-absorbing layer, and a layer capable of conversion from substantial liquid processing composition impermeability to a condition of substantial liquid processing composition permeability.

22 Claims, No Drawings

STRIPPING SHEET FOR USE WITH DIFFUSION TRANSFER FILM UNIT

BACKGROUND OF THE INVENTION

Procedures for preparing photographic images in silver by diffusion transfer principles are well known in the art. For the formation of positive silver images, a latent image contained in an exposed photosensitive silver halide emulsion is developed and almost concurrently therewith a soluble silver complex is obtained by reaction of a silver halide solvent with unexposed and undeveloped silver halide of said emulsion. The photosensitive silver halide emulsion is developed with a processing composition which may be spread between the photosensitive element comprising the silver halide emulsion and a second element which may comprise a suitable silver precipitating layer. The processing composition effects development of the latent image in the emulsion, and, substantially contemporaneous therewith, forms a soluble silver complex, for example, a thiosulfate or thiocyanate, with undeveloped silver halide. This soluble silver complex is at least in part transported in the direction of the print receiving layer and the silver thereof is precipitated in the silver precipitating element to form a positive image. Procedures of this description are disclosed, for example, in U.S. Pat. No. 2,543,181 issued to Edwin H. Land. See also Edwin H. Land, *One Step Photography,* Photographic Journal, Section A, pgs. 7–15, January 1950.

Additive color reproduction may be produced by exposing a photosensitive silver halide emulsion through an additive color screen having filter media or screen elements each of an individual additive color such as red or green or blue and by viewing the reversed or positive silver image formed by transfer to a transparent print receiving element through the same or a similar screen which is suitably registered with the positive image carried in the print receiving layer. As examples of suitable film structures for employment in additive color photography, mention may be made of U.S. Pat. Nos. 2,861,885; 2,726,154; 2,944,894; 3,536,488; 3,615,426; 3,615,427; 3,615,428; 3,615,429; and 3,894,871.

U.S. Pat. No. 3,674,482 issued July 4, 1972, is directed to a silver diffusion transfer film unit which comprises a support carrying on one surface, in order, a layer containing a silver precipitating nuclei, an inert non-nuclei-containing protective layer and a layer containing a photosensitive silver halide emulsion. The purpose of the non-nuclei-containing protective layer is to provide a layer over the transferred silver image after the emulsion layer has been removed subsequent to processing which protective layer will then be the outermost layer. The material for the protective layer is one which is readily permeable to the processing composition and which will not provide sites for the nucleation of the silver forming the transferred image. A particularly preferred material employed as a protective layer comprises chitosan (deacetylated chitin).

U.S. Pat. No. 4,056,392 issued Nov. 1, 1977 is directed to a diffusion transfer film unit which comprises, in order, an additive color screen, a layer comprising silver precipitating nuclei, a layer comprising a water-soluble cupric salt and a compound selected from the group consisting of chitosan and 2-amino-2-deoxyglucose, and a photosensitive silver halide emulsion layer. By employing a water-soluble copper salt in the chitosan protective layer an increase in $D_{max}$ is achieved with substantially no adverse effect on $D_{min}$ compared to a protective layer composed of chitosan alone.

U.S. Pat. No. 3,677,753 is directed to a photographic process wherein an exposed and processed film unit of the type described in U.S. Pat. No. 3,674,482 is contacted with a revolving roller having a coating thereon to which the photosensitive layer is more adherent than the adjacent layer of the film unit thereby detaching the photosensitive layer from the film unit.

SUMMARY OF THE INVENTION

The present invention is directed to a stripping sheet adapted for use with a diffusion transfer film unit to remove at least the photosensitive layer from said film unit subsequent to exposure and processing, wherein said stripping sheet comprises, in order, a support carrying a water-absorbing layer and a layer capable of conversion from substantial liquid processing composition impermeability to a condition of substantial liquid processing composition permeability. The film unit preferably comprises, a support, an image-receiving layer, and a photosensitive silver halide emulsion layer. In a particularly preferred embodiment, a protective layer and/or a release layer are disposed between the image-receiving layer and the silver halide emulsion layer.

DETAILED DESCRIPTION OF THE INVENTION

The patents referred to in the Background of the Invention describe diffusion transfer film units wherein the photosensitive silver halide layer is detached from the film unit subsequent to exposure and processing. The advantages of the removal of this layer reside in decreased densities in the $D_{min}$ region of the positive image in the case of transparencies, and enhanced stability of the positive image as a result of the removal of the residual processing composition and by-products of the development process which may be detrimental to the long term stability of the positive image in the case of both transparencies and reflection prints.

To remove such layers, the prior art has generally employed a so-called stripping or release layer, that is, a layer intermediate the layers that are to be removed and the remainder of the film unit, which release layer is softened or dissolved by the processing composition to facilitate the removal of the photosensitive layer and any other layers designed to be removed. The actual removal is accomplished by contacting the outermost layer, generally the photosensitive layer, with a layer, i.e. a stripping sheet, which will exhibit an adhesive capability thereby facilitating the removal from the film unit of the desired layers.

Since the polymeric material employed in the film unit is generally gelatin, a gelatin layer is often employed as the stripping sheet. It is believed that the stripping sheet functions by a dehydration effect on the liquid processing composition, resulting in an increase in the viscosity of the polymeric viscosity-increasing agent in the processing composition, forming a bond between the stripping sheet and the gelatin of the next adjacent layer in the film unit thereby permitting removal of the desired layers in the film unit with the stripping sheet.

The referred-to viscosity-increasing agent is generally an alkali-metal carboxymethyl cellulose or hydroxyethyl cellulose employed at a concentration adapted to facilitate the spreading of the processing composition.

It should be understood that, in the film units described, the stripping sheet of the present invention may also function substantially as a spreading layer; that is, facilitating the application of processing composition to the film unit, and thus contact the processing composition substantially contemporaneously with the film unit which is to be developed by the processing composition.

It has been found that if the development characteristics of the film unit requires an increasing amount of liquid processing composition then a thicker water-absorbing layer is required in the stripping sheet in order to obtain the necessary adhesion to provide efficient stripping of the layers in the film unit. However, an increase in the thickness of the water-absorbing layer of the stripping sheet results in a competition for the liquid processing composition which may result in a starving of the film unit of liquid processing composition with adverse effects on the image formation.

It has now been found that by employing, over the water-absorbing layer of the stripping sheet, a layer capable of conversion from substantial liquid processing composition impermeability to a condition of substantial liquid processing composition permeability that a time delay is effected whereby the processing composition can function to at least commence to develop and transfer the photographic image in the film unit before the stripping layer commences its processing composition dehydration function as a prelude to layer adhesion and removal of the desired layers of the film unit. Thus, by means of the present invention, the appropriate material for the so-called timing layer system, and the thickness of such a system, can be selected to provide a predetermined delay between the time the stripping sheet contacts the liquid processing composition-wetted film unit and the time it commences its dehydration action.

As examples of suitable water-absorbing materials for use in the water-absorbing layer of the present invention mention may be made of natural and synthetic materials, including paper, open-cell foam sponges, polymers and copolymers and combinations thereof. Preferred are polymers such as polyvinyl alcohol, hydroxyethyl cellulose, sodium carboxymethyl cellulose and derivatized starch. Particularly preferred is gelatin.

The materials selected for use in the present invention as the so-called timing layer, must become permeable after a predetermined period of time to the liquid processing composition and must form a bond with the polymeric thickener employed in the processing composition which becomes dehydrated as a result of the diffusion of liquid processing composition into the water-absorbing layer of the stripping sheet.

In a particularly preferred embodiment, the so-called timing layer comprises a mixture of gelatin and a carboxylated polyacrylate polymer. The gelatin comprises about 5–50% of the timing layer. As stated above, the composition and thickness of the timing layer is selected will respect to the desired delay in the contact between the liquid processing composition and the gelatin stripping layer. Thus, the timing layer may comprise about 50–300 mg/ft$^2$, more preferably, 100–200 mg/ft$^2$. The gelatin layer, as described above, is selected with respect to the quantity of processing composition employed and typically may be coated at a level ranging from about 250 mg/ft$^2$ to about 3000 mg/ft$^2$ and preferably 500 to 1000 mg/ft$^2$.

In an alternative embodiment, the timing layer is 100% of carboxylated polyacrylate polymer.

In another alternative embodiment, the timing layer comprises a gelatin layer which has been at least partially cross-linked by the addition of a conventional cross-linking agent known to the art, e.g., chrome alum.

In still another embodiment, the gelatin layer also includes zine acetate, preferably at a level ranging from about 5% to 20% and more preferably about 5 to 10% by weight of the gelatin. While not intending to be bound by theory, it is believed that the zinc ion may be leached from the gelatin into the timing layer providing a cross-linking effect with the carboxylated polyacrylate. It is also believed, however, that it does not function as a cross-linking agent for the gelatin. It has been found that the presence of zinc acetate in the strip sheet provides enhanced stripping.

In still a further alternate embodiment, zinc acetate is employed in the timing layer at a level of about 10–50% by weight of the carboxylated polyacrylate.

In still another alternative embodiment, particulate matter, at least about 2 $\mu$m in average diameter, such as silica particles ranging in size from about 2 to 10 $\mu$m, at a coverage ranging from about 10 mg/ft$^2$ to 25 mg/ft$^2$ is employed in the timing layer to both prevent blocking when the stripping layer is wound upon itself and to function as an anti-static agent to minimize the generation of static electricity when the stripping layer is unwound and contacted with the film unit to avoid the adverse photographic effects of the static electricity which may be generated by such unwinding.

The stripping layer of the present invention is particularly suitable for use with any type of film unit where one or more layers are to be removed from the film unit subsequent to exposure and processing, and, more specifically, where the layer retaining the positive image and the silver halide emulsion layer are to be separated from each other to provide the advantages referred to above. Thus, the image-receiving layer may be a dyeable image-receiving layer, in the case of a color diffusion transfer process, or a layer containing silver precipitating nuclei, in the case of a silver diffusion transfer process. Protective layers and release layers are employed at the option of the operator, although release layers are preferred.

As an example of film units employing dye-image providing materials with which the stripping layer of the present invention may be employed includes those disclosed and claimed in U.S. Pat. No. 3,245,791, issued Apr. 12, 1966 and German OLS 2,441,750 wherein the liquid processing composition contains a polymeric mordant and thereby constituting in solid form, the positive dye image subsequent to processing and stripping, as well as U.S. Pat. No. 2,983,606, issued May 9, 1961.

As examples of silver diffusion transfer film units employing the stripping layers of the present invention mention may be made of those disclosed and claimed in U.S. Pat. No. 3,674,482 and in copending application of Michael Berger, Charles H. Byers and John J. Magenheimer, Ser. No. 277,946; copending application of Michael Berger, Herbert L. Fielding and Warren J. Dillman, Ser. No. 277,616; copending application of Michael Berger, Ser. No. 277,945; copending application of Michael Berger and John J. Magenheimer, Ser. No.

277,921 filed concurrently herewith (common assignee).

The following non-limiting example illustrates the novel film units of the present invention.

EXAMPLE A

A film unit was prepared comprising a transparent polyester film base and carrying on one surface an additive color screen of approximately 1500 lines each per inch of red, blue, and green filter screen elements in repetitive side by side relationship; a 2.3 μm polyvinylidine chloride/polyvinyl formal layer; a nucleating layer comprising palladium nuclei at a coverage of about 0.23 mg/ft$^2$ of palladium (prepared according to the procedure of copending application Ser. No. 80,691 filed Oct. 1, 1979 now U.S. Pat. No. 4,281,056 issued July 28, 1981), 0.23 mg/ft$^2$ of gelatin and 1.0 mg/ft$^2$ of hydroxyethyl cellulose; a protective layer as described below; a release layer comprising about 6 mg/ft$^2$ hydroxyethyl cellulose and 2 mg/ft$^2$ of polyethylene emulsion; a hardened gelatino silver iodobromide emulsion panchromatically sensitized at a coverage of about 100 mg/ft$^2$ of silver; a top coat comprising gelatin, antihalation dyes and about 15 mg/ft$^2$ of 3μ silica particles.

Film units described above were prepared, exposed at 4 mcs with a daylight balanced Xenon flash to a multicolor target and processed with mechanical rollers at a 0.0020 in. gap disposing the processing composition between the top coat and the stripping sheets designated below. The film was held in the dark for one minute and then the stripping sheet was removed with the top coat and emulsion layers.

| | Weight % |
|---|---|
| PROCESSING COMPOSITION A | |
| Sodium hydroxide | 8.81 |
| Hydroxyethyl cellulose (sold by Hercules, Inc., Wilmington, Delaware under the tradename Natrosol 250 HH) | 1.87 |
| Tetramethyl reductic acid | 7.36 |
| Potassium bromide | 0.64 |
| Sodium sulfite | 0.85 |
| 2-methylthiomethyl-4,6-dihydroxypyrimidine | 7.36 |
| 4-aminopyrazolo-[3,4d]-pyrimidine | 0.02 |

-continued

| | Weight % |
|---|---|
| N—benzyl-α-picolinium bromide (50% solution) | 3.68 |
| Water | 69.41 |
| PROCESSING COMPOSITION B | |
| Sodium hydroxide | 8.54 |
| hydroxyethyl cellulose (sold by Hercules, inc., Wilmington, Delaware under the tradename Natrosol 250 HH) | 1.36 |
| Tetramethyl reductic acid | 5.83 |
| Potassium bromide | 0.68 |
| Sodium sulfite | 0.90 |
| 2-methylthiomethyl-4,6-dihydroxypyrimidine | 6.22 |
| 4-aminopyrazolo-[3,4d]-pyrimidine | 0.02 |
| N—benzyl-α-picolinium bromide (50% solution) | 3.11 |
| Water | 73.35 |

TABLE 1

| | Stripping Sheet | | D max | | |
|---|---|---|---|---|---|
| Example | Gelatin Layer | Timing Layer | Red | Green | Blue |
| 1 | 1000 mg/ft$^2$ gelatin<br>100 mg/ft$^2$ zinc acetate | — | 2.39 | 2.27 | 2.29 |
| 2 | 1000 mg/ft$^2$ gelatin<br>100 mg/ft$^2$ zinc acetate | 100 mg/ft$^2$ carboxylated polyacrylate | 2.58 | 2.49 | 2.42 |
| 3 | 1000 mg/ft$^2$ gelatin<br>100 mg/ft$^2$ zinc acetate | 200 mg/ft$^2$ carboxylated polyacrylate | 2.56 | 2.51 | 2.46 |
| 4 | 1000 mg/ft$^2$ gelatin<br>100 mg/ft$^2$ zinc acetate | 170 mg/ft$^2$ carboxylated polyacrylate<br>30 mg/ft$^2$ gelatin | 2.54 | 2.52 | 2.42 |
| 5 | 1000 mg/ft$^2$ gelatin<br>100 mg/ft$^2$ zinc acetate | 255 mg/ft$^2$ carboxylated polyacrylate<br>45 mg/ft$^2$ gelatin | 2.54 | 2.52 | 2.42 |
| 6 | 1000 mg/ft$^2$ gelatin<br>100 mg/ft$^2$ zinc acetate | 140 mg/ft$^2$ carboxylated polyacrylate<br>60 mg/ft$^2$ gelatin | 2.55 | 2.47 | 2.44 |
| 7 | 1000 mg/ft$^2$ gelatin<br>100 mg/ft$^2$ zinc acetate | 210 mg/ft$^2$ carboxylated polyacrylate<br>90 mg/ft$^2$ gelatin | 2.57 | 2.53 | 2.46 |
| 8 | 500 mg/ft$^2$ gelatin<br>50 mg/ft$^2$ zinc acetate | — | 2.37 | 2.27 | 2.28 |

The carboxylated polyacrylate employed in the above examples was CARBOSET XL-22 Resin, The B. F. Goodrich Co., Cleveland, Ohio supplied as a 40% solids dispersion in ammonia water. The above film units were processed with Processing Composition B.

It will be seen from Table 1 that employing a timing layer provides substantially higher densities than does a stripping sheet without a timing layer. This illustrates the competition for the processing composition between the film unit and the stripping sheet which results in diminished transfer of image silver to the silver precipitating layer. In all the above examples, the stripping was substantially complete, i.e., little, if any, residue remained on the protective layer subsequent to stripping.

In order to evaluate the permeation time of the timing layer, a strip sheet was prepared comprising a polyester support carrying a layer comprising, 500 mg/ft$^2$ gelatin, 50 mg/ft$^2$ zinc acetate and 3.7 mg/ft$^2$ of an indicator dye, thymolphthalein, which changes from colorless to blue at an alkaline pH. The strip sheet also contained the below-indicated timing layers coated over the gelatin layer. The strip sheet was processed with mechanical rollers at a 0.0020 in. gap disposing the processing composition between the strip sheet and a clear polyester sheet. The elapsed time for the dye color to first appear was measured, indicating the length of time the timing layer held back the processing composition.

TABLE 2

| Example | Timing Layer | Permeation Delay (seconds) |
|---|---|---|
| 9 | — | 0 |
| 10 | 92.5 mg/ft$^2$ carboxylated polyacrylate 7.5 mg/ft$^2$ gelatin | 8 |
| 11 | 85 mg/ft$^2$ carboxylated polyacrylate 25 mg/ft$^2$ gelatin | 8 |
| 12 | 200 mg/ft$^2$ carboxylated polyacrylate | 10 |
| 13 | 150 mg/ft$^2$ carboxylated polyacrylate | 5 |
| 14 | 100 mg/ft$^2$ carboxylated polyacrylate | 5 |
| 15 | 50 mg/ft$^2$ carboxylated polyacrylate | 5 |

The time delay characteristics of the timing layer and how it can be varied in composition and coverage is illustrated in Table 2.

Table 3 shows the effect of the timing layer on density with respect to time. The film structure employed contained no protective layer.

The film units described above were exposed at 4 mcs with a daylight balanced Xenon flash to a multi-color target and processed with mechanical rollers at a 0.0018 in. gap disposing Processing Composition A between the top coat and a stripping sheet carrying a layer comprising 500 mg/ft$^2$ gelatin and 50 mg/ft$^2$ zinc acetate and the timing layer designated below. The film was held in the dark for the time indicated and the top coat and emulsion layers were removed with the stripping sheet.

TABLE 3

| | | 30" Dmax | | | 45" Dmax | | | 60" Dmax | | | 180" Dmax | | |
|---|---|---|---|---|---|---|---|---|---|---|---|---|---|
| Example | Timing Layer | Red | Green | Blue | Red | Green | Blue | Red | Green | Blue | Red | Green | Blue |
| 16 | None | 1.82 | 1.88 | 1.82 | 2.40 | 2.56 | 2.36 | 2.56 | 2.72 | 2.52 | 2.64 | 2.80 | 2.62 |
| 17 | 85 mg/ft$^2$ carboxylated polyacrylate 15 mg/ft$^2$ gelatin | 2.14 | 2.34 | 2.14 | 2.50 | 2.68 | 2.48 | 2.56 | 2.72 | 2.52 | 2.60 | 2.78 | 2.60 |
| 18 | 200 mg/ft$^2$ carboxylated polyacrylate | 2.20 | 2.38 | 2.18 | 2.56 | 2.68 | 2.50 | 2.68 | 2.82 | 2.64 | 2.62 | 2.80 | 2.60 |
| 19 | 100 mg/ft$^2$ carboxylated polyacrylate | 2.10 | 2.22 | 2.04 | 2.56 | 2.68 | 2.50 | 2.60 | 2.68 | 2.56 | 2.68 | 2.62 | 2.82 |

From Table 3 it will be seen that the positive image densities increase at a more rapid rate employing the stripping sheet of the present invention.

Table 4 shows film units of the type described above exposed and processed in the same manner as those described in Table 3. The one minute positive image densities are shown for film units processed with a stripping sheet comprising 500 mg/ft$^2$ gelatin and 50 mg/ft$^2$ zinc acetate and the indicated timing layer.

TABLE 4

| | | One Minute Dmax Density | | |
|---|---|---|---|---|
| Example | Timing Layer | Red | Green | Blue |
| 16 | None | 2.56 | 2.72 | 2.52 |
| 17 | 185 mg/ft$^2$ carboxylated polyacrylate 15 mg/ft$^2$ gelatin | 2.80 | 2.82 | 2.70 |
| 18 | 170 mg/ft$^2$ carboxylated polyacrylate 30 mg/ft$^2$ gelatin | 2.56 | 2.72 | 2.52 |
| 19 | 200 mg/ft$^2$ carboxylated polyacrylate | 2.68 | 2.82 | 2.64 |
| 20 | 150 mg/ft$^2$ carboxylated polyacrylate | 2.76 | 2.80 | 2.68 |
| 21 | 100 mg/ft$^2$ carboxylated polyacrylate | 2.60 | 2.68 | 2.56 |
| 22 | 50 mg/ft$^2$ carboxylated polyacrylate | 2.72 | 2.76 | 2.70 |

From Table 4 it will be seen that significantly enhanced positive image densities are obtained after one minute employing stripping sheets with timing layers than stripping sheets without timing layers, indicating that there is less immediate competition for the processing composition when stripping layers of the present invention are employed, thus resulting in a more efficient use of the processing composition in positive image formation, particularly at lower temperature processing conditions.

The support employed in the present invention is not critical. The support or film base employed may comprise any of the various types of rigid or flexible supports. For example, glass, polymeric films of both the synthetic type and those derived from natural occurring products, including paper, may be employed. If a transparency is desired, a transparent support is employed; if a reflection print is desired, an opaque support is employed. Especially suitable materials comprise flexible transparent synthetic polymers such as polymethacrylic acid; methyl and ethyl esters; vinyl chloride polymers; polyvinyl acetals; polyamides such as nylon; polyesters such as the polymeric films derived from ethylene glycol terephthalic acid; polymeric cellulose derivitives such as cellulose acetate propionate; polycarbonates; polystyrenes and the like.

The additive color screen employed in the present invention may be formed by techniques well known in the art. For example, by sequentially printing the requisite filter patterns by photomechanical methods. An additive color screen comprises an array of sets of colored areas or filter elements usually from 2–4 different colors, each of said sets of colored areas being capable of transmitting visible light within a predetermined wavelength range. In the most common situations. The additive color screen is trichromatic and each set of color filter elements transmits light within one of the so called primary wavelength ranges, i.e., red, green, or blue. The additive color screen may be composed of minute dyed particles such as starch grains or hardened gelatin particles intermixed and interspersed in a regular or random arrangement to provide a mosaic. A regular mosaic of this type may be made by an alternating embossing and doctoring technique described in U.S. Pat. No. 3,019,124. Another method of forming a suitable color screen comprises multiline extrusion of the type disclosed in U.S. Pat. No. 3,032,008, the colored lines being deposited side-by-side in a single coating operation. Still another method is set forth in U.S. Pat. No. 3,284,208.

Silver halide solvents useful in forming the desired soluble complex with unexposed silver are well known and, for example, may be selected from the alkali metal thiosulfates, particularly sodium or potassium thiosulfates, particularly sodium or potassium thiosulfates, or the silver halide solvent may be cyclic imide, such as uracil, in combination with a nitrogenous base as taught in U.S. Pat. No. 2,857,274 issued Oct. 21, 1958 to Edwin H. Land, or pseudouracils, such as the 4,6-dihydroxypyrimidines as taught in U.S. Pat. No. 4,126,459, issued Nov. 21, 1978. While the silver halide solvent is preferably initially present in the processing composition, it is within the scope of this invention to initially position the silver halide solvent in a layer of the film unit, preferably in the form of a precursor which releases or generates the silver halide solvent upon contact with an alkaline processing fluid.

The processing composition may contain a thickening agent, such as an alkali metal carboxymethyl cellulose or hydroxyethyl cellulose, in a quantity and viscosity grade adapted to facilitate application of the processing composition. The requisite alkalinity, e.g., a pH of 12–14, is preferably imparted to the processing composition, by employing an alkali metal hydroxide, such as sodium, potassium and/or lithium hydroxide. A wetting agent may be advantageously included in the processing composition to facilitate application thereof, particularly where the processing composition is applied in a very thin layer of low viscosity fluid.

Suitable silver halide developing agents may be selected from among those known in the art, and may be initially positioned in a layer of the photosensitive element and/or in the processing composition. Organic silver halide developing agents are generally used, e.g., organic compounds of the benzene or naphthalene series containing hydroxyl and/or amino groups in the para- or ortho-positions with respect to each other, such as hydroquinone, tert-butyl hydroquinone, toluhydroquinone, p-aminophenol, 2,6-dimethyl-4-aminophenol, 2,4,6-triaminophenol, etc. If the additive color transparency is one which is not washed after processing to remove unused silver halide developing agent, development reaction products, etc., the silver halide developing agent(s) should not give rise to colored reaction products which might stain the image or which, either unreacted or reacted, might adversely affect the stability and sensitometric properties of the final image. Particularly useful silver halide developing agents having good stability in alkaline solution are substituted reductic acids, particularly tetramethyl reductic acid, as disclosed in U.S. Pat. No. 3,615,440 issued Oct. 26, 1971 to Stanley M. Bloom and Richard D. Cramer, and $\alpha,\beta$-enediols as disclosed in U.S. Pat. No. 3,730,716 issued to Edwin H. Land, Stanely M. Bloom and Leonard C. Farney on May 1, 1973.

What is claimed is:

1. A method which comprises the steps (a) exposing a diffusion transfer film unit comprising a support carrying, in order, an image-receiving layer, and a photosensitive silver halide emulsion layer;

(b) disposing a liquid processing composition intermediate a stripping sheet and the outermost layer of said film unit distal to the support;

(c) contacting said outermost layer of said film unit distal to the support with said stripping sheet wherein said stripping sheet comprises a support carrying, in order, a water-absorbing layer and a timing layer capable of conversion from substantial liquid processing composition impermeability to a condition of substantial liquid processing composition permeability; whereby said timing layer converts from said substantial liquid processing composition impermeability to said substantial liquid processing composition permeability thereby forming a bond between said outermost layer and said stripping sheet; and (d) detaching said stripping sheet and at least the photosensitive layer of the film unit adhered to said stripping sheet from the rest of the film unit.

2. The method of claim 1 wherein said image-receiving layer is a dye image-receiving layer.

3. The method of claim 1 wherein said image-receiving layer contains silver precipitating nuclei.

4. The method of claim 1 wherein said film unit includes a protective layer intermediate said image-receiving layer and said photosensitive silver halide layer.

5. The process of claim 1 wherein said film unit includes a top coat containing an antihalation material.

6. The process of claim 5 wherein said top coat contains gelatin.

7. The process of claim 1 wherein said film unit includes a release layer intermediate said protective layer and said silver halide emulsion layer.

8. The process of claim 1 wherein said liquid processing composition includes a viscosity increasing polymeric material.

9. The process of claim 1 wherein said water-absorbing layer comprises gelatin.

10. The process of claim 1 wherein said timing layer comprises gelatin and a carboxylated polyacrylate.

11. The process of claim 1 wherein said water-absorbing layer ranges from about 250 to 3000 mg/ft$^2$ of gelatin.

12. The process of claim 11 wherein said gelatin is present at a level of about 1000 mg/ft$^2$.

13. The process of claim 11 wherein said water-absorbing layer includes about 3 to 15% of zinc acetate based on the weight of gelatin.

14. The process of claim 13 wherein said zinc acetate is present at a level of about 10% based on the weight of said gelatin layer.

15. The process of claim 10 wherein said timing layer includes zinc acetate.

16. The process of claim 15 wherein said zinc acetate is present at a level of about 10–50% based on the weight of the carboxylated polyacrylate.

17. The process of claim 1 wherein said timing layer consists essentially of carboxylated polyacrylate.

18. The process of claim 1 wherein said timing layer comprises cross-linked gelatin.

19. The process of claim 1 wherein said timing layer includes particulate matter at least about 2$\mu$ in average diameter therein.

20. The process of claim 19 wherein said particulate matter comprises silica particles.

21. The process of claim 1 wherein said stripping sheet and at least said photosensitive layer are detached subsequent to substantial positive silver image formation.

22. The process of claim 1 wherein said film unit is an additive color diffusion transfer film unit.

* * * * *